US006612431B2

(12) United States Patent
Faircloth

(10) Patent No.: US 6,612,431 B2
(45) **Date of Patent: *Sep. 2, 2003**

(54) GARMENT PACKAGE WITH FOLDABLE FLAPS, DOWNWARDLY EXTENDING GARMENT COVERING TAB, AND ATTACHED HANGER

(75) Inventor: Michael E. Faircloth, Lexington, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/851,744

(22) Filed: May 9, 2001

(65) Prior Publication Data

US 2001/0030136 A1 Oct. 18, 2001

Related U.S. Application Data

(63) Continuation-in-part of application No. 09/469,115, filed on Dec. 21, 1999, now Pat. No. 6,237,762.

(51) Int. Cl.[7] ..... B65D 85/18
(52) U.S. Cl. ..... 206/299; 206/297
(58) Field of Search ..... 206/281, 288, 206/297, 299, 461, 806; D9/433

(56) References Cited

U.S. PATENT DOCUMENTS

| | | | | |
|---|---|---|---|---|
| 3,794,793 A | | 2/1974 | Rius | |
| 4,014,436 A | | 3/1977 | Tunis | |
| 4,190,151 A | | 2/1980 | Russell | |
| 4,257,522 A | | 3/1981 | Thorneburg | |
| 4,601,417 A | * | 7/1986 | Kunreuther | 206/292 |
| 5,027,945 A | * | 7/1991 | Wilkins | 206/278 |
| 5,405,022 A | * | 4/1995 | Rissley | 206/461 |
| 5,469,959 A | | 11/1995 | Gummer | |
| D421,568 S | | 3/2000 | Ferguson et al. | |
| 6,237,762 B1 | * | 5/2001 | Faircloth | 206/297 |

* cited by examiner

*Primary Examiner*—David T. Fidei
(74) *Attorney, Agent, or Firm*—Kilpatrick Stockton LLP

(57) ABSTRACT

A package for housing and protecting a folded garment has a back and two front foldable flaps. Each front foldable flap has two foldable sections, and each section has a partial side. A top covers the upper edge of the folded garment and is formed into a downwardly extending tab positioned between the folded garment and the front foldable flaps. A pressure-sensitive hanging element is adhesively attached to the back and extends through an opening in the top garment covering portion to accommodate repeated removal and hanging on a display support member.

33 Claims, 2 Drawing Sheets

GARMENT PACKAGE WITH FOLDABLE FLAPS, DOWNWARDLY EXTENDING GARMENT COVERING TAB, AND ATTACHED HANGER

CROSS REFERENCE TO RELATED APPLICATIONS

This application claims priority to, and incorporates herein in-full by reference, Applicant's co-pending non-provisional patent application having U.S. Ser. No. 09/469,115, filed Dec. 21, 1999.

FIELD OF THE INVENTION

The present invention relates to a garment package and, more particularly, to a garment package for housing and protecting a folded garment having foldable front flaps, a depending and protective top, and a hanger attached to the package to facilitate hanging the package on a display support member.

BACKGROUND OF THE INVENTION

Packaging for folded and displayed garments, such as socks and other hosiery products, normally consists of an insert or a type of inner support means and a band holding the folded garment against the support means so that the fabric of the garment can be seen and touched by a shopper. Since it is an encouragement to the shopper to feel the fabric of a garment, often the garment is removed from the band and support member and thereafter unfolded for a more complete study. In many cases, the shopper is not inclined to take the time and effort to carefully refold the garment and reposition it on the support member and within the band. Thus, the band, support member, and garment are usually casually laid back on the display, likely in an unhung and rather unattractive condition, making it very unlikely to be viewed by subsequent shoppers. Frequent maintenance of such displays is therefore required in order to refold and reposition the garment on the support member and within the band or to replace the unwrapped garment with a new package.

Other prior devices involve the use of more than one surrounding band in an effort to secure the garment more rigidly to a support member and resist removal of the garment from the member by a shopper. In that style package, one band encircles two folded leg members of a garment, and the second band then encompasses the entire garment when a fold is made over the first band with a section of the folded leg. This type of package is somewhat more effective in resisting removal of a garment from the support, or backing, member; however, the garment is still exposed and has a tendency to collect dust and other debris that might be in close proximity to the display. While it does require some effort to remove the garment for additional inspection from the two bands and backing member, such activity frequently does occur, resulting in an unhung package in disarray as previously described. The garment must be refolded and repositioned into the existing package, and, if damaged, the package and garment must be replaced.

There is no relatively inexpensive and cooperatively designed package that will secure a garment within a package, protect the garment from dust and other debris to which it may be exposed, and minimize the maintenance required in refurbishing and repackaging folded displayed products such as socks and hosiery. Since these requirements are critical to the successful and ongoing display of products of this nature, it is to these desirable features that the present invention is directed.

There is a desire and need to display packaging in an manner observable by shoppers. Hanging packages, for example, flat hosiery packages, on a display requires some form of hanging device to be utilized with the package that will engage a support member on the display and maintain the package in the desired location. Hanging tabs that are integral cut-outs or extensions of a cardboard package are often used for this purpose. However, repeated removal of packages by customers from a display for closer inspection and rehanging causes wear on cardboard-type hanging tabs, resulting in damage to the hanging tab and package. Indeed, a single, sufficiently rigorous pull of a package from a display support member can tear a cardboard hanging tab from a package. As such, cardboard-type hanging tabs often do not provide the strength or flexibility of material or construction to allow repeated removal and replacement on display members. Thus, there is a need for a hanging package that provides a stronger, more durable, and more flexible hanging element for repeated removal and hanging on a display support member. There is also a need for a hanging hosiery package having a stronger, more durable, and more flexible hanging element that is inexpensive to manufacture and use. Prior packages have not combined the advantages of an inexpensive design that will secure a garment within a package, protect the garment from dust and other debris, and minimize the maintenance required in refurbishing and repackaging folded displayed products with a stronger, more durable, and more flexible hanging element for repeated removal and hanging on a display member. It is to these perceived needs that the present invention is directed.

SUMMARY OF THE INVENTION

The present invention relates to a garment package and, more particularly, to a garment package for housing and protecting a folded garment having foldable front flaps, a depending and protective top, and a hanger attached to the package to facilitate hanging the package on a display member.

A package of the present invention includes a back and first and second foldable front flaps each having first and second foldable sections. Each foldable section of each foldable front flap forms a partial side for the package, protecting the housed garment along these sides from touch or removal. A top has a garment covering portion and a depending tab positionable between the folded garment and the closed first and second foldable flaps to shield the garment from dust and debris and resist removal of the garment from the package. In embodiments, the top has an opening cut in the garment covering portion. A package of the present invention further includes a hanging element, for example, a pressure-sensitive hanger, adaptable to be attached to the package. The hanging element is preferably plastic. When the hanging element is attached to the back of the package and the top garment covering portion is folded in an approximately perpendicular relationship with the back, the hanging element extends through the opening and above the package to facilitate hanging the package. The package is particularly useful in holding for display hosiery products, such as fine denier hosiery and socks.

Features of a package of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

One advantage is that the present invention provides packages capable of protecting a folded and displayed article from dust or debris and from otherwise being spoiled by the touch of a prospective customer.

Another advantage is that packages of the present invention resist to a great degree the removal of a garment from the structure of the package for a more intimate examination by the prospective customer, which often results in disarray and/or destruction of the package.

Another advantage of packages of the present invention is that the garment covering portion of the top prevents a garment from easily falling out of the package.

Another advantage is that the present invention provides a package that will resist tampering and removal of a housed garment and thereby minimize maintenance time and replacement costs associated with conventional packaging of this nature.

Another advantage is that packages of the present invention permit a garment to be hung on a display or otherwise attractively presented.

Embodiments of the present invention provide the advantage of packages having a hanger that will permit the package to be more reliably suspended from a display support member.

Another advantage is that packages of the present invention provide a pressure-sensitive hanger that is sufficiently strong, durable, and flexible to accommodate repeated removal and hanging on a display support member.

Still another advantage is that the present invention provides packages having a stronger, more durable, and more flexible hanging element and that are relatively inexpensive to manufacture and use.

Thus, there has been broadly outlined the more important features of the invention in order that the detailed description that follows may be better understood and in order that the present contribution to the art may be better appreciated. There are, obviously, additional features of the invention that will be described hereinafter which will form the subject matter of the claims appended hereto. With respect to the invention in detail, it is to be understood that the invention is not limited in its application to the details and construction and to the arrangement of the components set forth in the following description or illustrated in the drawings. The invention is capable of other embodiments and of being practiced and carried out in several ways.

It is also to be understood that the phraseology and terminology used herein are for the purpose of description and should not be regarded as limiting in any respect. Those skilled in the art will appreciate the concept upon which this disclosure is based and that it may readily be utilized as a basis for designing other structures, methods, and systems for carrying out the several purposes of the invention. Additional uses, objects, advantages, and novel features of the invention are set forth in the detailed description that follows and will become more apparent to those skilled in the art upon examination of the following or by practice of the invention.

This summary of the invention, along with the various features of novelty which characterize the invention, are pointed out with particularity in the claims annexed to and forming a part of this disclosure. For a better understanding of the invention, its operating advantages, and the specific objects obtained by its use, reference should be made to the accompanying drawings and descriptive matter in which like characters of reference designate like parts throughout the several views.

DETAILED DESCRIPTION

Figure 1:
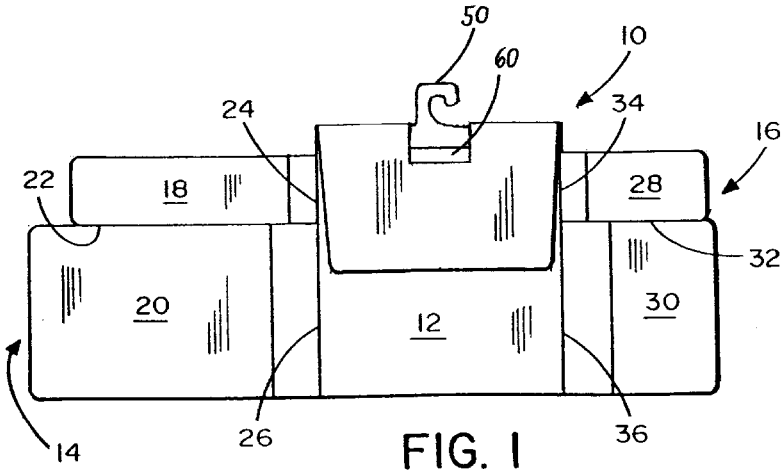
FIG. 1 is a front elevational view of a package showing foldable front flaps in an open condition in an embodiment of the present invention.
Figure 2:
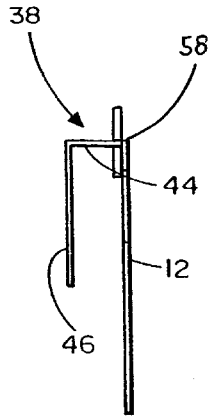
FIG. 2 is a side elevational view of the open and empty package of FIG. 1 in an embodiment of the present invention.

Referring now to the drawings and particularly to FIG. 1, in an embodiment of the present invention, an open and empty garment package is shown generally as 10 and includes a back 12, a first foldable front flap 14 and a second foldable front flap 16. First foldable front flap 14 has first and second sections 18, 20 separated by a slit 22 so that section 18 is hingedly connected to back 12 along line 24 and section 20 is hingedly connected to back 12 along line 26. Similarly, flap 16 is divided into two sections 28, 30 which are separated at slit 32. Section 28 is hingedly connected to back 12 along line 34, and section 30 is hingedly connected to back 12 along line 36.

Figure 3:
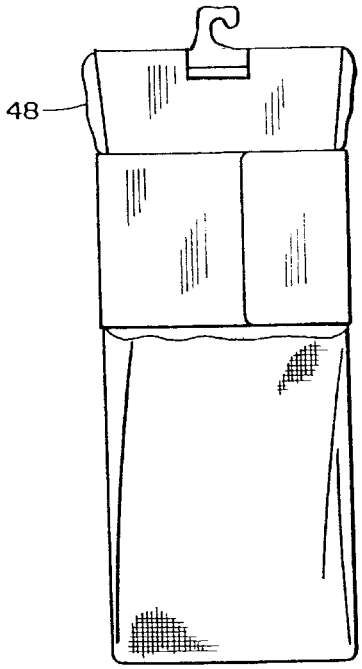
FIG. 3 is a front elevational view of the package of FIG. 1 supporting a folded leg garment with the foldable front flaps in the closed or garment-encircling condition in an embodiment of the present invention.
Figure 4:
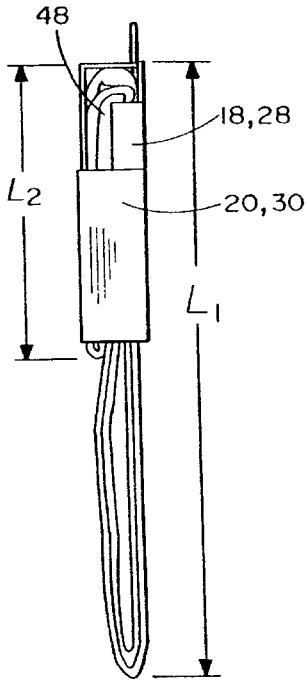
FIG. 4 is a side elevational view of the package and garment shown in FIG. 3 in an embodiment of the present invention.

In an embodiment of the present invention, a top shown generally as 38 includes a garment covering area 44, which is hingedly connected to back 12 along line 58, and a depending tab 46 which is positioned between foldable flaps 20, 30 and folded garment 48. Thus area 44 of top 38 extends over and covers the folded product 48 so that product 48 is shielded from the accumulation of dust or other debris. Tab 46 of top 38 extends downwardly as shown in FIG. 4 and becomes encircled and secured within the band formed by sections 20 and 30 when they are in the closed position as shown in FIGS. 3 and 4. A small amount of glue (not shown) can be positioned on the surface of tab 46 or sections 20, 30 so that tab 46 bonds with sections 20, 30 when they are in the closed position and thus resist removal therefrom by a shopper.

In an embodiment of the present invention, when garment 48 is placed within package 10 in a preliminary folded condition, it is longer than the packaged garment shown in FIG. 3. The length of the garment in that folded condition is the sum of the distances L1 and L2 shown in FIG. 4. The fold is over first foldable sections 18, 28 and encircles the garment in the first folded condition as shown in FIG. 4. Garment length L2 is then folded over joined foldable sections 18, 28 at which time sections 20, 30 are positioned to totally encircle the garment and tab 46 in the second or final fold position.

Figure 5:
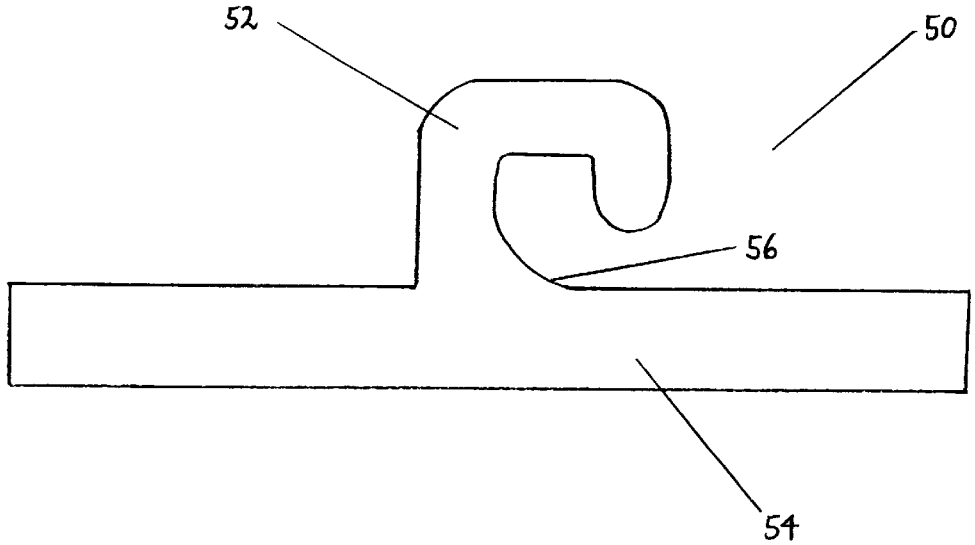
FIG. 5 is a front elevational view of a pressure-sensitive hanger showing the hook, shoulder, and adhesive portions as used in the package of FIG. 1 in an embodiment of the present invention.

In embodiments, a portion of top 38 is cut away from fold line 58 between back 12 and garment covering portion 44 and extending into garment covering portion 44 to form an opening 60. Referring to FIG. 5, in a preferred embodiment, a pressure-sensitive hanger 50 having a hook portion 52 and an adhesive portion 54 is adaptable to be adhesively attached to the package. A pressure-sensitive hanger is thus defined as a hanger having at least one adhesive surface that can be adhesively attached to another surface by applying pressure. As seen in FIGS. 1 and 3, when hanger 50 is adhesively attached with adhesive portion 54 to back 12 and garment covering portion 44 is folded in a substantially perpendicular relationship with back 12, hook portion 52 of hanger 50 extends through opening 60 and above the package to facilitate hanging the package on a display support member. Pressure-sensitive hangers of the present invention can be made of any suitable material having sufficient strength, durability, and flexibility to accommodate repeated removal from and replacement on a display member. In a preferred embodiment, pressure-sensitive hanger 50 is plastic and has sufficient strength and flexibility to accommodate being pulled from a display support member without easily tearing.

In a particularly preferred embodiment of the present invention, pressure-sensitive hanger 50 includes an adhesive material, such as a self-adhesive, on one side of adhesive portion 54 to be applied to back 12. A "self-adhesive" is an adhesive that adheres itself to a surface upon contact. In operation, a packaging machine (not shown) automatically applies pressure to adhesive portion 54 causing the adhesive material to attach pressure-sensitive hanger 50 to back 12. With hanging element 50 adhesively attached to back 12, a garment, such as a hosiery product, is placed within package 10 as described above. As garment covering portion 44 is folded over and hanger 50 is positioned through opening 60, shoulder 56 of hanger 50 extends in both directions underneath garment covering portion 44 toward foldable front flaps 14 and 16. Shoulder 56 rests against garment covering portion 44, providing further support and strength to the package/hanger interface to accommodate repeated removal of the package from and replacement on a display support member.

In embodiments of the present invention, a package for maintaining and protecting a garment in a folded condition comprises: a back having opposing sides; a first foldable front flap having first and second foldable sections, each of the foldable sections of the first foldable front flap foldably connected to one side of the back; a second foldable front flap having first and second foldable sections, each of the foldable sections of the second foldable front flap foldably connected to the opposing side of the back; a top foldably connected to the back, the top having a garment covering portion foldable to a substantially perpendicular relationship with the back and a depending tab adjacent to the foldable front flaps, the garment covering portion having an opening cut therein; and a hanger attached to the back so as to extend through the opening and above the package to facilitate hanging the package.

In embodiments, the first foldable front flap has a first foldable section and a second foldable section, and the second foldable front flap has a first foldable section and a second foldable section. The first front foldable flap first foldable section forms a first package partial side and the first front foldable flap second foldable section forms a second package partial side, and the first and second partial sides have different thicknesses. The second front foldable flap first foldable section forms a third package partial side and the second front foldable flap second foldable section forms a fourth package partial side, and the third and fourth partial sides have different thicknesses.

In embodiments of packages of the present invention, the first foldable section of each of the first and second foldable front flaps is substantially equal. In embodiments, the second foldable section of each of the first and second front foldable flaps is substantially equal. The first and second foldable front flap first foldable sections are adaptable to overlap in a closed position to shield and resist removal of the garment from the package. The first and second foldable front flap second foldable sections are adaptable to overlap in a closed position to shield and resist removal of the garment from the package. In embodiments, the top depending tab is nested between the garment and the first and second front foldable flaps to shield and resist removal of the garment from the package.

In embodiments, the first and third package partial sides have the same thickness and the second and fourth package partial sides have the same thickness. In embodiments, the first and third package partial side thickness is approximately half the second and fourth package partial side thickness.

In embodiments of the present invention, the hanger comprises shoulders extending toward the first and second foldable front flaps and resting underneath the garment covering portion to provide connective support between the package and the hanger. In embodiments, the hanger is plastic. In preferred embodiments, the hanger is a pressure-sensitive hanger having an adhesive portion. Most preferably, the pressure-sensitive hanger adhesive portion further comprises a self-adhesive. Embodiments of the present invention comprise the pressure-sensitive hanger adhesively attached to the package back.

In the present invention, the hanger can be automatically applied to the package back. In embodiments, a package of the present invention comprises a knitted hosiery garment positioned within the package.

Thus, an embodiment of a package for maintaining and protecting a garment in a folded condition has been described and illustrated in operable form. Although the present invention has been described with reference to particular embodiments, it should be recognized that these embodiments are merely illustrative of the principles of the present invention. Optimal dimensional relationships for the parts of the invention should be readily apparent to those of ordinary skill in the art. All equivalent relationships to those described in the specification and illustrated in the drawings are intended to be encompassed herein. Those of ordinary skill in the art will appreciate that packages of the present invention may be constructed and implemented in other ways and embodiments. Accordingly, the description herein should not be read as limiting the present invention, as other embodiments also fall within the scope of the present invention.

What is claimed is:

1. A package for maintaining and protecting a garment in a folded condition comprising:

a back having opposing sides;

a first foldable front flap having first and second foldable sections, each of the foldable sections of the first foldable front flap foldably connected to one side of the back;

a second foldable front flap having first and second foldable sections, each of the foldable sections of the second foldable front flap foldably connected to the opposing side of the back;

a top foldably connected to the back, the top having a garment covering portion foldable to a substantially perpendicular relationship with the back and a depending tab adjacent to the foldable front flaps, the garment covering portion having an opening cut therein; and a hanger attached to the back so as to extend through the opening and above the package to facilitate hanging the package.

2. The package of claim 1, wherein the first foldable front flap has a first foldable section and a second foldable section, and the second foldable front flap has a first foldable section and a second foldable section.

3. The package of claim 2, wherein the first front foldable flap first foldable section forms a first package partial side and the first front foldable flap second foldable section forms a second package partial side, the first and second partial sides having different thicknesses.

4. The package of claim 3, wherein the second front foldable flap first foldable section forms a third package partial side and the second front foldable flap second foldable section forms a fourth package partial side, the third and fourth partial sides having different thicknesses.

5. The package of claim 1, wherein the top depending tab is nested between the garment and the first and second front foldable flaps to shield and resist removal of the garment from the package.

6. The package of claim 2, wherein the top depending tab is nested between the garment and the first and second front foldable flaps to shield and resist removal of the garment from the package.

7. The package of claim 4, wherein the top depending tab is nested between the garment and the first and second front foldable flaps to shield and resist removal of the garment from the package.

8. The package of claim 4, wherein the first foldable section of each of the first and second foldable front flaps is substantially equal.

9. The package of claim 4, wherein the second foldable section of each of the first and second front foldable flaps is substantially equal.

10. The package of claim 8, wherein the first foldable front flap first foldable section and the second front foldable flap first foldable section are adaptable to overlap in a closed position to shield and resist removal of the garment from the package.

11. The package of claim 10, wherein the first foldable front flap second foldable section and the second front foldable flap second foldable section are adaptable to overlap in a closed position to shield and resist removal of the garment from the package.

12. The package of claim 4, wherein the first and third package partial sides have the same thickness and the second and fourth package partial sides have the same thickness.

13. The package of claim 12, wherein the first and third package partial side thickness is approximately half the second and fourth package partial side thickness.

14. The package of claim 1, wherein the hanger is automatically applied to the package back.

15. The package of claim 1, wherein a knitted hosiery garment is positioned within the package.

16. The package of claim 1, wherein the hanger comprises shoulders extending toward the first and second foldable front flaps and resting underneath the garment covering portion to provide connective support between the package and the hanger.

17. The package of claim 1, wherein the hanger is a pressure-sensitive hanger.

18. The package of claim 1, wherein the hanger is plastic.

19. The package of claim 17, wherein the pressure-sensitive hanger is plastic.

20. The package of claim 17, wherein the pressure-sensitive hanger comprises an adhesive portion.

21. The package of claim 17, wherein the pressure-sensitive hanger adhesive portion further comprises a self-adhesive.

22. The package of claim 17, wherein the pressure-sensitive hanger is adhesively attached to the package back.

23. The package of claim 12, wherein the top depending tab is nested between the garment and the first and second front foldable flaps to shield and resist removal of the garment from the package.

24. The package of claim 23, wherein the hanger is automatically applied to the package back.

25. The package of claim 23, wherein a knitted hosiery garment is positioned within the package.

26. The package of claim 23, wherein the hanger comprises shoulders extending toward the first and second foldable front flaps and resting underneath the garment covering portion to provide connective support between the package and the hanger.

27. The package of claim 23, wherein the hanger is a pressure-sensitive hanger.

28. The package of claim 23, wherein the hanger is plastic.

29. The package of claim 27, wherein the pressure-sensitive hanger is plastic.

30. The package of claim 27, wherein the pressure-sensitive hanger comprises an adhesive portion.

31. The package of claim 27, wherein the pressure-sensitive hanger adhesive portion further comprises a self-adhesive.

32. The package of claim 27, wherein the pressure-sensitive hanger is adhesively attached to the package back.

33. A package for maintaining and protecting a garment in a folded condition comprising:

a back having opposing sides;

a first foldable front flap having first and second foldable sections, each of the foldable sections of the first foldable front flap foldably connected to one side of the back;

a second foldable front flap having first and second foldable sections, each of the foldable sections of the second foldable front flap foldably connected to the opposing side of the back;

a top foldably connected to the back, the top having a garment covering portion foldable to a substantially perpendicular relationship with the back and a depending tab adjacent to the foldable front flaps, the garment covering portion having an opening cut therein; and a plastic, pressure-sensitive hanger having an adhesive portion attached to the back so as to extend through the opening and above the package to facilitate hanging the package, wherein the first foldable front flap first foldable section forms a first package partial side and the first front foldable flap second foldable section forms a second package partial side, the first and second partial sides having different thicknesses;

wherein the second front foldable flap first foldable section forms a third package partial side and the second front foldable flap second foldable section forms a fourth package partial side, the third and fourth partial sides having different thicknesses;

wherein the first and third package partial sides have the same thickness and the second and fourth package partial sides have the same thickness, and the first and third package partial side thickness is approximately half the second and fourth package partial side thickness;

wherein the first foldable front flap first foldable section and the second front foldable flap first foldable section are adaptable to overlap in a closed position and the first foldable front flap second foldable section and the second front foldable flap second foldable section are adaptable to overlap in a closed position;

wherein the top depending tab is nested between the garment and the first and second front foldable flaps to shield and resist removal of the garment from the package;

wherein the hanger further comprises shoulders extending toward the first and second foldable front flaps and resting underneath the garment covering portion to provide connective support between the package and the hanger; and wherein a knitted hosiery garment is positioned within the package.

* * * * *